US007204044B2

(12) United States Patent
Hoffer et al.

(10) Patent No.: US 7,204,044 B2
(45) **Date of Patent: *Apr. 17, 2007**

(54) SOLE FOR ARTICLE OF FOOTWEAR FOR GRANULAR SURFACES

(75) Inventors: Kevin Hoffer, Portland, OR (US); Tobie D. Hatfield, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 110 days.

This patent is subject to a terminal disclaimer.

(21) Appl. No.: 10/820,439

(22) Filed: Apr. 6, 2004

(65) Prior Publication Data

US 2005/0217150 A1 Oct. 6, 2005

(51) Int. Cl.
*A43B 5/04* (2006.01)
*A43B 23/28* (2006.01)

(52) U.S. Cl. ..... 36/116; 36/114; 36/25 R; 36/59 R

(58) Field of Classification Search ..... 36/116, 36/25 R, 59 R, 59 C, 114, 8.1
See application file for complete search history.

(56) References Cited

U.S. PATENT DOCUMENTS

| | | | | |
|---|---|---|---|---|
| 583,641 | A * | 6/1897 | Brown | 36/32 R |
| 2,071,431 | A * | 2/1937 | Riddell | 36/14 |
| 2,773,317 | A * | 12/1956 | Boesen Helle | 36/11.5 |
| 2,930,149 | A * | 3/1960 | Hack et al. | 36/28 |
| 3,129,520 | A | 4/1964 | Funck | |
| 3,490,155 | A | 1/1970 | Herunter | 36/2.5 |
| 3,947,979 | A | 4/1976 | Sidles | 36/32 R |
| 4,094,081 | A * | 6/1978 | Reiner et al. | 36/116 |
| 4,096,649 | A * | 6/1978 | Saurwein | 36/32 R |
| 4,259,792 | A | 4/1981 | Halberstadt | 36/28 |
| 4,309,831 | A | 1/1982 | Pritt | 36/3 R |
| 4,372,058 | A | 2/1983 | Stubblefield | 36/32 R |
| 4,389,798 | A | 6/1983 | Tilles | 36/129 |
| 4,402,145 | A * | 9/1983 | Dassler | 36/32 R |
| 4,569,142 | A | 2/1986 | Askinasi | 36/134 |
| 4,607,440 | A * | 8/1986 | Roberts et al. | 36/114 |
| 4,741,114 | A * | 5/1988 | Stubblefield | 36/32 R |
| 4,827,631 | A | 5/1989 | Thornton | 36/102 |
| 5,077,916 | A | 1/1992 | Beneteau | 36/114 |
| 5,079,856 | A | 1/1992 | Truelsen | 36/25 R |
| 5,815,949 | A | 10/1998 | Sessa | 36/3 B |
| 5,918,385 | A * | 7/1999 | Sessa | 36/59 C |
| 6,385,866 | B1 * | 5/2002 | Sotter | 36/67 R |
| 6,615,512 | B2 * | 9/2003 | Sink | 36/127 |

FOREIGN PATENT DOCUMENTS

| | | |
|---|---|---|
| DE | 1 674 858 | 3/1954 |
| FR | 1434840 | 6/1996 |
| GB | 2 072 486 | 10/1981 |
| GB | 2 249 939 | 5/1992 |

* cited by examiner

*Primary Examiner*—Marie Patterson
(74) *Attorney, Agent, or Firm*—Banner & Witcoff, Ltd.

(57) ABSTRACT

A sole for an article of footwear to be used on a granular surface includes a sole of compressible material having an upper surface and a lower surface. A peripheral lip projects downwardly and outwardly from the lower surface of the sole. A plurality of fins projects downwardly from the lower surface of the sole.

37 Claims, 4 Drawing Sheets

SOLE FOR ARTICLE OF FOOTWEAR FOR GRANULAR SURFACES

FIELD OF THE INVENTION

This invention relates generally to a sole for an article of footwear, and, in particular, to a sole for an article of footwear suitable for use on granular surfaces.

BACKGROUND OF THE INVENTION

Current shoe designs, and, more specifically, current shoe sole designs, do not work particularly well when used by individuals to walk, run, jump or otherwise move on granular surfaces, e.g., sand and snow. Current shoe designs are limiting in that much of the energy exerted by the wearer is lost, since the wearer's shoe tends to slip when they move. This energy loss is prevalent during propulsion as well as during braking or stopping.

This is especially problematic when the wearer is running, playing volleyball, or engaged in any type of athletic activity in which traction and the ability to stop quickly are paramount. The competitive nature of some athletic activities being performed on granular surfaces, e.g., professional beach volleyball, and the increase in the number of such athletic activities in which people are engaged, has brought greater attention to this issue and increased the need for a solution.

It is an object of the present invention to provide a sole for an article of footwear for granular surfaces that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, a sole for an article of footwear to be used on a granular surface includes a sole having an upper surface and a lower surface. A peripheral lip projects downwardly and outwardly from the lower surface. A plurality of transverse fins projects downwardly from the lower surface.

In accordance with another aspect, an article of footwear for granular surfaces includes an upper and a sole secured to the upper. The sole has a peripheral lip projecting downwardly and outwardly and a plurality of fins extending transversely and projecting downwardly.

In accordance with yet another aspect, a sole for an article of footwear to be used on a granular surface includes a sole of compressible material having an upper surface and a lower surface. A peripheral lip projects downwardly and outwardly from the lower surface. An inner lip projects downwardly and outwardly from the lower surface, and is spaced inwardly of the peripheral lip such that a recess is formed between the peripheral lip and the inner lip. The inner lip extends around a heel portion of the sole, with a portion of the recess being filled with the compressible material. A slit is formed in a toe portion of the sole, extends rearwardly from the peripheral lip, and is positioned between a portion of the sole configured to support a big toe of a wearer and a portion of the sole configured to support a second toe of a wearer. A first plurality of transversely extending fins projects downwardly and rearwardly from the lower surface and is positioned in a forward portion of the sole. The slit divides some of the first plurality of transverse fins into first and second segments, with some of the first plurality of fins being formed of a first segment and a second segment spaced apart from one another by a gap. The gap is aligned with the slit. A transition fin is positioned rearwardly of the first plurality of fins and has a front surface projecting rearwardly and downwardly from the lower surface and a rear surface projecting forwardly and downwardly from the lower surface. A second plurality of fins projects downwardly and forwardly from the lower surface and is positioned rearwardly of the transition fin. A rear fin has a transversely extending front surface that projects substantially perpendicular to the lower surface and a rear surface that extends in substantially semi-circular fashion between opposed ends of the front surface and projects substantially perpendicular to the lower surface.

Substantial advantage is achieved by providing a sole for an article of footwear for granular surfaces having a sole with a downwardly and outwardly projecting peripheral lip and a plurality of downwardly projecting fins. In particular, the peripheral lip bends outwardly upon contact with the granular surface, increasing the contact surface of the footwear and, therefore, increasing traction. The peripheral lip also retains portions of the granular surface beneath the sole, reducing the tendency for the article of footwear to sink beneath the surface. The downwardly projecting fins increase the surface area of the sole, thereby increasing traction for propulsion and braking. When used on hard surfaces, the peripheral lip and fins collapse and moderate impact forces incurred by the wearer. Consequently, the peripheral lip and fins allow the wearer to operate their foot with less effort and more comfort.

These and additional features and advantages of the invention disclosed here will be further understood from the following detailed disclosure of certain preferred embodiments.

Figure 1:
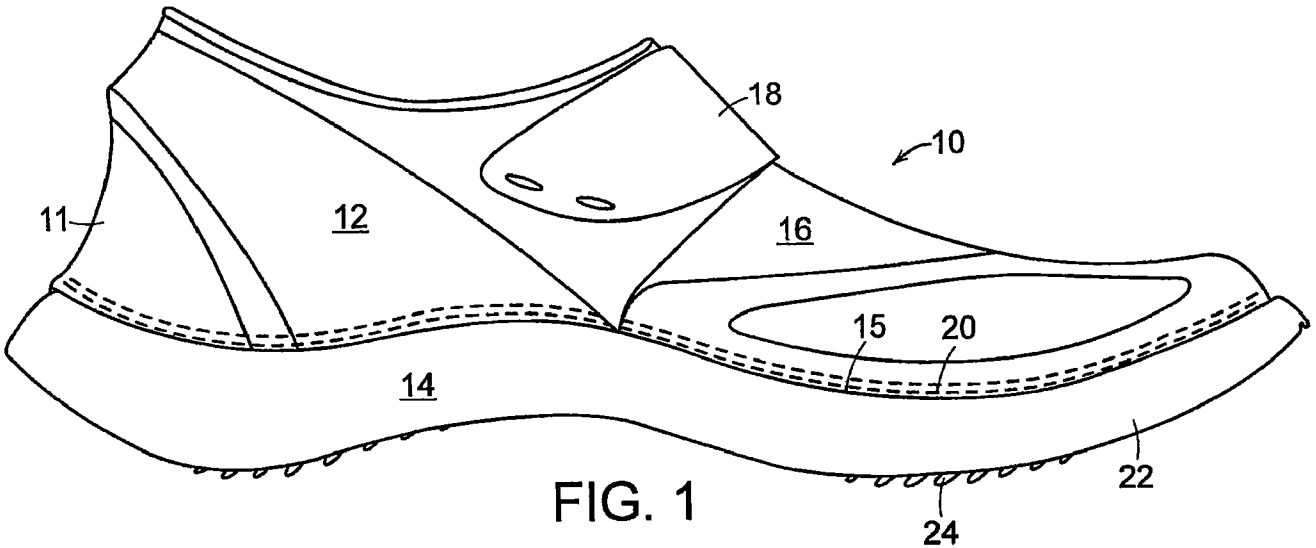
FIG. 1 is an elevation view of an article of footwear with a sole in accordance with a preferred embodiment of the present invention.
Figure 2:
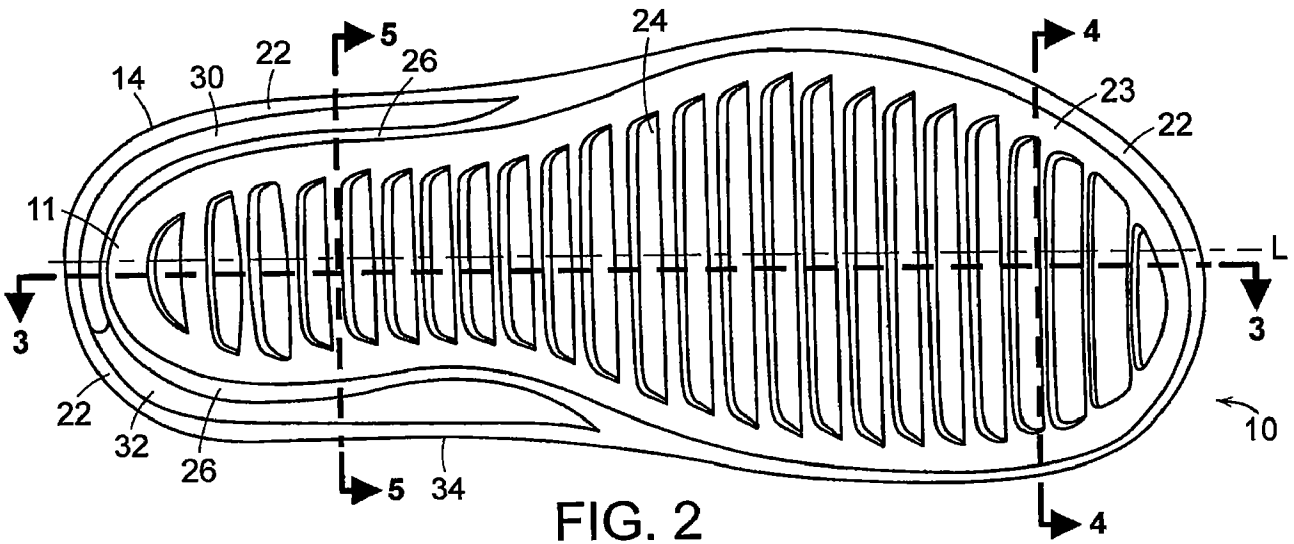
FIG. 2 is a plan view of the underside of the sole of FIG. 1.
Figure 3:
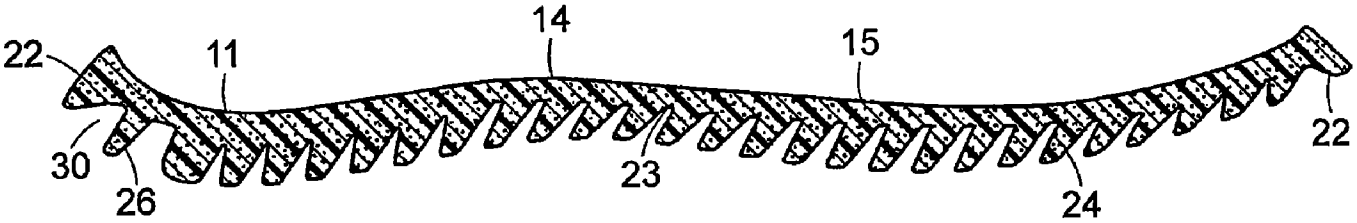
FIG. 3 is a section view taken along the line 3—3 of FIG. 2.

The figures referred to above are not drawn necessarily to scale and should be understood to present a representation of the invention, illustrative of the principles involved. Some features of the sole for an article of footwear for granular surfaces depicted in the drawings have been enlarged or distorted relative to others to facilitate explanation and understanding. The same reference numbers are used in the drawings for similar or identical components and features shown in various alternative embodiments. Soles for articles of footwear for granular surfaces as disclosed herein, would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear such as a shoe 10 is shown in FIG. 1. Shoe 10 includes a heel portion 11, a toe portion 13, an upper 12 and a sole 14. Upper 12 is secured to an upper surface 15 of sole 14 by adhesive or other suitable fastening means. In the illustrated embodiment, an instep 16 of upper 12 includes a fastener 18 for securing a wearer's foot within upper 12. Fastener 18 may be a hook and loop fastener, as shown here, laces, cords or any other suitable shoe instep fastener. Fasteners for use on footwear are well known to those skilled in the art, and other suitable fasteners will become readily apparent to those skilled in the art, given the benefit of this disclosure. An insole 20 may be positioned within upper 12 adjacent the wearer's foot, providing cushioning for the foot of the wearer.

It is to be appreciated that shoe 10 may include a midsole in addition to insole 20 and sole 14. As shown here, sole 14 provides the functions of a midsole, which include controlling potentially harmful foot motions, such as over pronation, shielding the foot from excessive ground reaction forces, and beneficially utilizing such ground reaction forces for more efficient toe-off. Naturally, sole 14 also provides the typical function of a sole, that is, being the ground-contacting element of shoe 10, and is usually fashioned from a durable, wear resistant material that includes texturing to improve traction. Consequently, in certain preferred embodiments, a midsole could be formed as an element of shoe 10, distinct from sole 14.

Unless otherwise stated, or otherwise clear from the context below, directional terms used herein, such as rearwardly, forwardly, inwardly, downwardly, upwardly, etc. , refer to directions relative to shoe 10 itself. Shoe 10 is shown in FIG. 1 to be disposed substantially horizontally, as it would be positioned on a horizontal surface when worn by a wearer. However, it is to be appreciated that shoe 10 need not be limited to such an orientation. Thus, in the illustrated embodiment of FIG. 1, rearwardly is toward heel portion 11, that is, to the left as seen in FIG. 1. Naturally, forwardly is toward toe portion 13, that is, to the right as seen in FIG. 1 and downwardly is toward the bottom of the page as seen in FIG. 1. Inwardly is toward the center of shoe 10, and outwardly is toward the outer peripheral edge of shoe 10.

As illustrated in FIG. 1, with fastener 18 formed on upper 12, shoe 10 is suitable for vigorous athletic activities (e.g., running, volleyball, soccer) performed on granular surfaces such as sand, snow, pebbly surfaces or any other surface comprising a plurality of granular elements. Other configurations of upper 12 are also considered to be within the scope of the present invention. For example, upper 12 could be formed of a stretchable mesh material, commonly found in footwear referred to as water shoes or water socks. Alternatively, upper 12 could be formed of a plurality of straps such that shoe 10 takes the form of a sandal. Other suitable configurations for upper 12 will become readily apparent to those skilled in the art, given the benefit of this disclosure.

Sole 14 is preferably formed of a compressible material, which helps to absorb some of the impact forces encountered by sole 14 in use, and allows portions of sole 14 to flex. Exemplary materials for sole 14 include, but are not limited to, foams, such as ethyl vinyl acetate (EVA), carbon black rubber, polyurethane, foamed rubber and non-foamed polymers. Other suitable materials for sole 14 will become readily apparent to those skilled in the art, given the benefit of this disclosure. Sole 14 may be manufactured by injection molding, pouring, compression molding, or any other suitable manufacturing method.

As seen in FIGS. 2–5, a peripheral lip 22 projects downwardly and outwardly from a lower surface 23 of sole 14 about a peripheral edge of sole 14. Peripheral lip 22 bends outwardly upon contact with the surface upon which the wearer is traveling, increasing the contact area of the sole with the surface and, therefore, increasing traction. When the surface comprises sand, snow or other granular surfaces, the outward bending of peripheral lip 22 and resultant increased surface area advantageously helps prevent shoe 10 from sinking beneath the surface by retaining some of the granular elements beneath sole 14.

Figure 5:
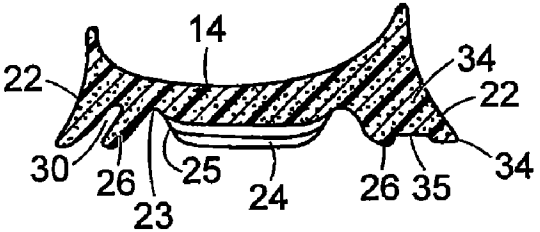
FIG. 5 is a section view taken along the line 5—5 of FIG. 2.
Figure 4:
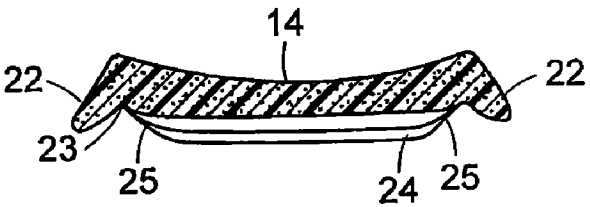
FIG. 4 is a section view taken along the line 4—4 of FIG. 2.

A plurality of transverse fins 24 projects downwardly from sole 14. Transverse fins 24 extend substantially perpendicular to longitudinal axis L of sole 14. In the embodiment illustrated in FIGS. 1–3, each of fins 24 projects downwardly and rearwardly from lower surface 23 of sole 14. In certain preferred embodiments, as can be seen in FIGS. 4–5, outer edges 25 of fins 24 are angled inwardly from lower surface 23 of sole 14.

When shoe 10 is used on a granular surface, fins 24 scoop into the surface, providing increased surface area and an increased coefficient of friction for sole 14, and, consequently, increased traction. The increased traction from fins 24 allows the wearer's foot to operate with less effort. When shoe 10 is used on hard surfaces, such as pavement or concrete, fins 24 collapse on one another to moderate impact forces. positioned inwardly of peripheral lip 22, and projects downwardly and outwardly from lower surface 23 of sole 14. Inner lip 26 extends around heel portion 11, forming a recess 30 between peripheral lip 22 and inner lip 26. Inner lip 16 provides extra support around heel portion 11 of shoe 10, and additional traction.

In certain preferred embodiments, a filler 32 is disposed in a portion of recess 30. In the illustrated embodiment, filler 32 is found in the portion of recess 30 extending from approximately a middle of heel portion 11 along an inner side 34 of sole 14 to the end of recess 30. The term inner side, as used herein refers to that side of shoe 10 that would face the other shoe and foot of the wearer. As seen here filler 32 substantially fills this portion of recess 30, leaving a small groove 35, as seen in FIG. 5. Filler 32 may be formed of the same material as sole 14, i. e. , EVA, or any other material suitable for sole 14.

Figure 6:
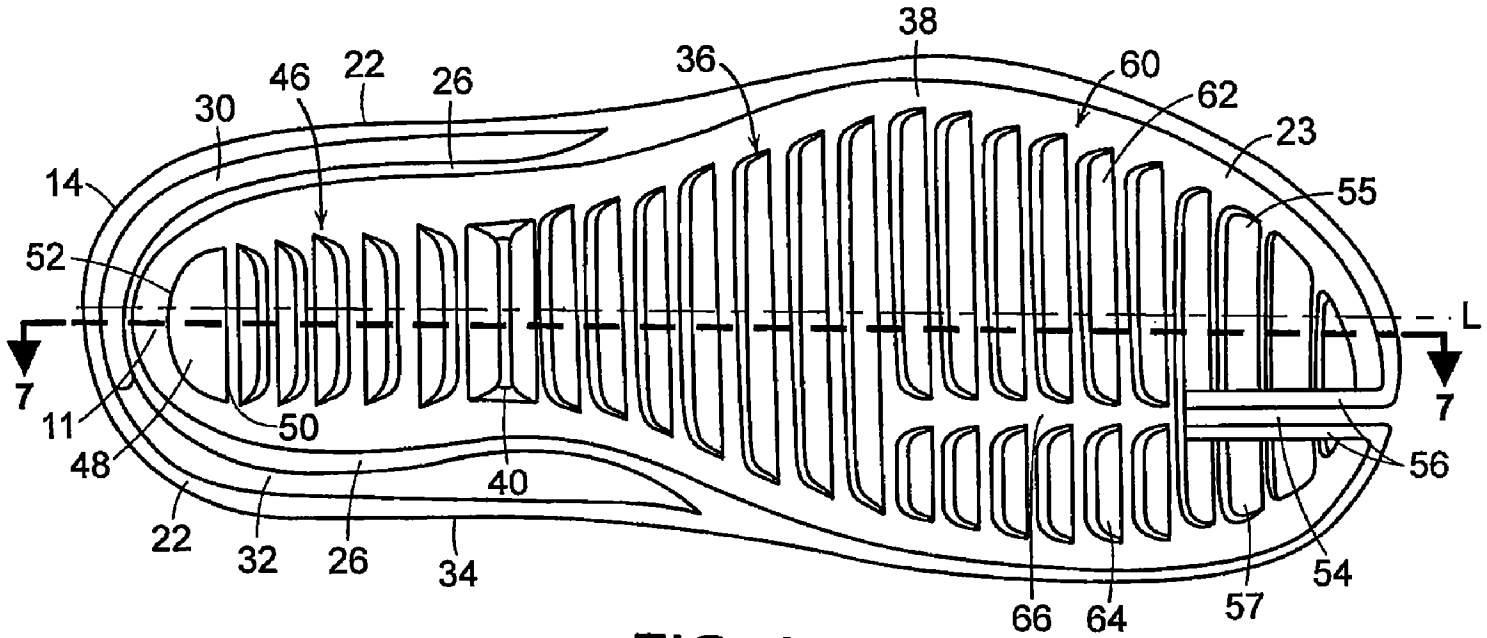
FIG. 6 is a plan view of an alternative embodiment of the sole of FIG. 1.

Another preferred embodiment is shown in FIG. 6. In this embodiment, a first plurality of fins 36 is disposed in a forward region 38 of sole 14, in the area where the toes and ball of the wearer's foot will be positioned. Fins 36 are angled rearwardly from lower surface 23 of sole 14.

Figure 7:
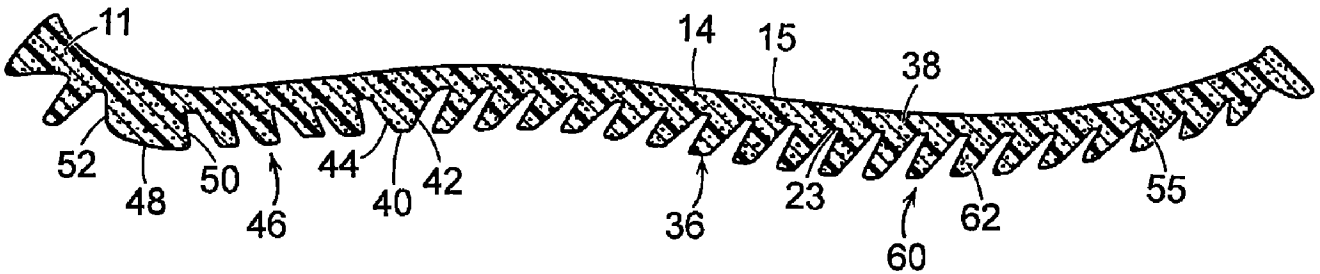
FIG. 7 is a section view taken along the line 7—7 of FIG. 6.

A transition fin 40 is positioned behind fins 36, proximate a forward edge of heel portion 11 of sole 14. Transition fin 40, as seen in FIG. 7 has a front surface 42 that angles rearwardly and downwardly from lower surface 23, and a rear surface 44 that angles forwardly and downwardly from lower surface 23. Rear surface 44 serves to provide traction, while front surface 42 serves to aid in braking or stopping shoe 10.

A second plurality of fins 46 is positioned in heel portion 11 rearwardly of transition fin 40. Fins 46 are angled forwardly from lower surface 23 of sole 14. Fins 46 serve to aid in braking or stopping shoe 10. A rear fin 48 is positioned rearwardly of fins 46, and has a front surface 50 projecting substantially perpendicular to lower surface 23 of sole 14. A rear surface 52 of fin 48 also projects substantially perpendicular to lower surface 23, and extends in a substantially semi-circular fashion from opposed ends of front surface 50, as can be seen in FIG. 6. Fin 48 also serves to aid in braking or stopping shoe 10. As can be seen in the drawings, the different angled surfaces of the fins of sole 14 are designed to be oriented in a direction to provide a desired force, be it a traction force or a braking force.

In another preferred embodiment, a slit 54 is formed in toe portion 13, and extends rearwardly from peripheral lip 22. Slit 54 is preferably positioned in toe portion 13 such that it extends between the big and second toes of a wearer of shoe 10. Lips 56 extend along opposed sides of slit 54 and project downwardly from lower surface 23 of sole 14. Lips 56 may be formed as separate elements abutting peripheral lip 22, or they may be contiguous with peripheral lip 22. Slit 54 and lips 56 act to divide a plurality of fins 24 into first portions 55 and second portions 57 that extend outwardly from lips 56. Slit 54 increases the flexibility of toe portion 13 and serves to reduce the lever action across toe portion 13 of sole 14. Therefore, the big toe of a wearer can move somewhat independently of the wearer's other toes vertically in the plantar and dorsal directions, and transverse directions, that is, in the lateral and medial directions, providing an increased effective surface area for sole 14.

In certain preferred embodiments, some fins 60 of the plurality of fins 38, which are positioned rearward of slit 54 in forward portion 38, comprise a first segment 62 and a second segment 64 separated by a longitudinal gap 66. Constructing fins 60 of separate segments separated by gap 66 enhances the flexibility of forward portion 38 of shoe 10 in the lateral and medial directions.

Figure 8:
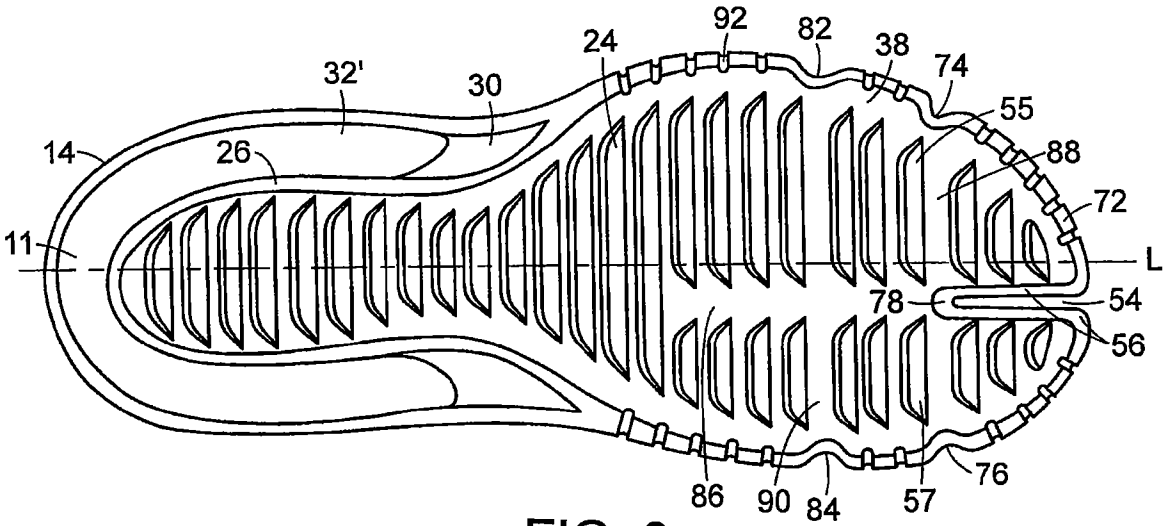
FIG. 8 is a plan view of an alternative embodiment of the sole of FIG. 1.

Another preferred embodiment of sole 14 is shown in FIG. 8. In this embodiment, a peripheral lip 72 extends around the periphery of sole 14, including the periphery of slit 54, such that peripheral lip 72 is contiguous with lips 56 that are positioned on opposite sides of, and define slit 54. A first lateral indentation 74 is formed in outer edge of peripheral lip 72, laterally outward of an end 78 of slit 54 on the lateral side of sole 14. A first medial indentation 76 is formed in an outer edge of peripheral lip 72, inward of the end 78 of slit 54 on the medial side of sole 14. A second lateral indentation 82 is formed in an outer edge of peripheral lip 72 rearwardly of first lateral indentation 74 on the lateral side of sole 14. A second medial indentation 84 is formed in an outer edge of peripheral lip 72 rearwardly of first medial indentation 76.

A plurality of fins 24 in forward portion 38 of sole 14 are divided into first portions 55 and second portions 57, with some of the first portions 55 spaced apart from corresponding second portions 57 by slit 54, and the remaining first portions 55 and second portions 57 spaced apart from one another by a longitudinal gap 86 that extends rearwardly from, and is aligned with, slit 54.

The fins 24 that are positioned forwardly and rearwardly, respectively, of end 78 and lateral indentation 74 and medial indentation 76 are spaced apart from one another by a transverse gap 88. Similarly, the fins 24 that are positioned forwardly and rearwardly, respectively, of lateral indentation 82 and medial indentation 84 are spaced apart from one another by a transverse gap 90. Gaps 88 and 90, as well as indentations 74, 76, 82, 84 act to provide additional flexibility for sole 14, allowing forward portion 38 of sole 14 to more easily flex up and down. This is especially advantageous when sole 14 is part of a running shoe for granular surfaces.

In the illustrated embodiment, fins 24 are all angled toward a rear of shoe 10 to provide traction, which is also advantageous when sole 14 is used for a running shoe.

In this embodiment, recess 30 is filled with filler 32' over the majority of its length, with filler 32' extending around heel portion 11 and filling all but a short segment of recess 30 at each end thereof. Filling the majority of recess 30 provides additional cushioning in heel portion 11, which can be advantageous when sole 14 is used in a running shoe for granular surfaces.

In certain embodiments, as illustrated here, a plurality of grooves 92 is formed in the lower surface of peripheral lip 72, about forward portion 38 of sole 14. Grooves 92 provide additional surface area for sole 14, thereby increasing traction for the user.

Figure 9:
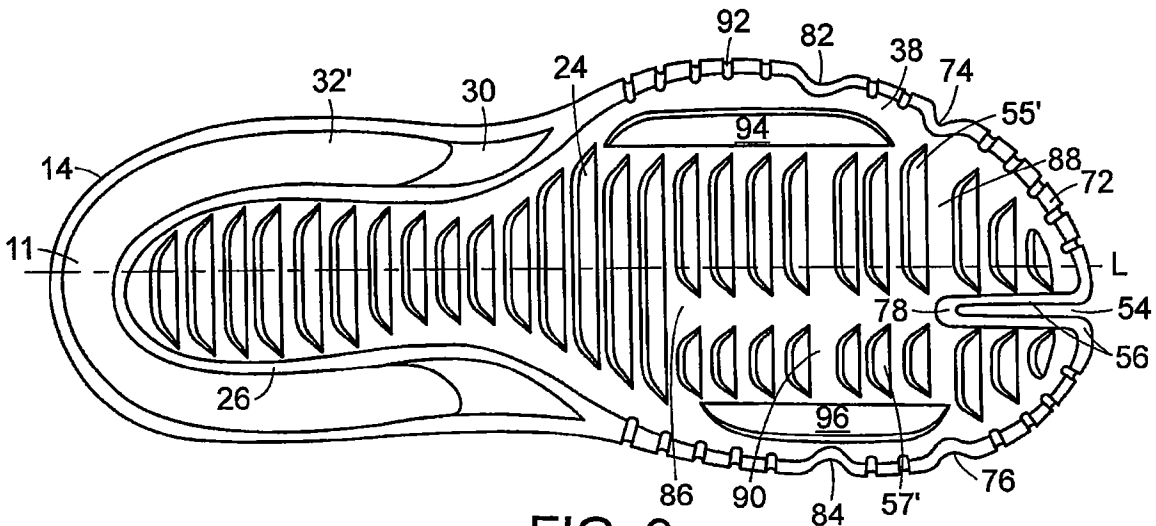
FIG. 9 is a plan view of an alternative embodiment of the sole of FIG. 1.

Another preferred embodiment of sole 14 is illustrated in FIG. 9, in which a lateral fin 94 and a medial fin 96 each extend downwardly and outwardly from lower surface 23 of sole 14. Lateral fin 94 is positioned in forward portion 38 and on the lateral side of sole 14, outward of first portions 55', while medial fin 96 is positioned in forward portion 38 on the medial side of sole 14, inward of second portions 57'. Lateral fin 94 and medial fin 96 extend substantially parallel to longitudinal axis L of sole 14. Lateral fin 94 and medial fin 96 serve to provide traction for a user when they move laterally, that is, sideways on a granular surface. This can be especially advantageous for athletic activities, e.g., beach volleyball, in which the user must be able to move quickly from side to side.

It is to be appreciated that although the embodiments illustrated and described herein show transverse fins that extend substantially perpendicular to longitudinal axis L and lateral and medial fins that extend substantially parallel to longitudinal axis L, other orientations of fins that project downwardly from lower surface 23 of sole 14 are considered to be within the scope of the invention. For example, sole 14 could include fins oriented at any angle with respect to longitudinal axis L. The actual orientation of the fins depends on the direction and type (e.g., propulsion or braking) of the desired force. Suitable orientations of fins for particular applications will become readily apparent to those skilled in the art, given the benefit of this disclosure.

Figure 10:
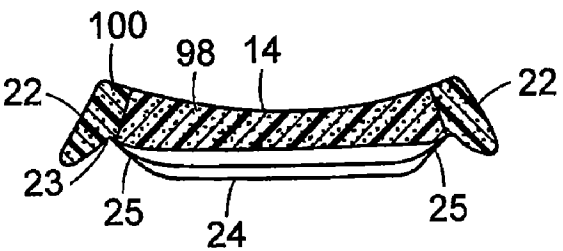
FIG. 10 is a section view of an alternative embodiment of the sole of FIG. 1.

Another preferred embodiment is illustrated in FIG. 10, in which sole 14 is formed of two different pieces. In the illustrated embodiment, sole 14 is formed of a first portion 98 and a second portion 100. Fins 24 are a part of first portion 98, while peripheral lip 22 is a part of second portion 100. First portion 98 may be formed of a first material while second portion 100 may be formed of a second material that is different than the first material. In certain preferred embodiments, first portion 98 may have a different color than second portion 100, which can improve the aesthetic appeal of sole 14.

In embodiments where first portion 98 has a different color than second portion 100, they may or may not be formed of the same material. Similarly, in embodiments where first portion 98 is formed of a different material than second portion 100, they may or may not have the same color.

Figure 11:
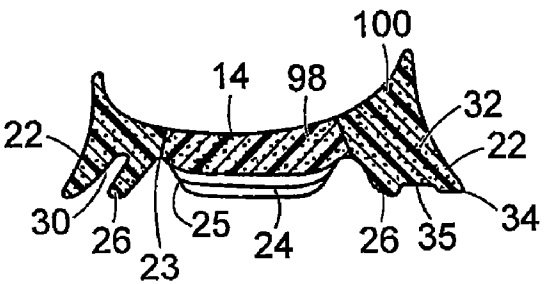
FIG. 11 is a section view of another alternative embodiment of the sole of FIG. 1.

Another embodiment is illustrated in FIG. 11, in which fins 24 are a part of first portion 98 while both peripheral lip 22 and inner lip 26 are parts of second portion 100.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A sole for an article of footwear to be used on a granular surface comprising, in combination:

a sole having an upper surface and a lower surface;

a peripheral lip projecting downwardly and outwardly from the lower surface and extending about the entire periphery of the lower surface;

a plurality of fins projecting downwardly from the lower surface, at least some of the fins angled rearwardly from the lower surface, and at least some of the fins extending transversely across substantially an entire width of the lower surface; and an inner lip projecting downwardly and outwardly from the lower surface and spaced inwardly of the peripheral lip such that a recess is formed between the peripheral lip and the inner lip, the inner lip extending around a heel portion of the sole.

2. The sole of claim 1, wherein all of the fins are angled rearwardly from the lower surface.

3. The sole of claim 1, wherein some of the fins are angled forwardly from the lower surface.

4. The sole of claim 1, wherein a portion of the recess is filled.

5. The sole of claim 1, wherein the sole is formed of a compressible material.

6. The sole of claim 5, wherein the compressible material is ethyl vinyl acetate.

7. The sole of claim 1, wherein outer edges of the fins are angled inwardly from the lower surface.

8. The sole of claim 1, further comprising a slit formed in a toe portion of the sole, the slit extending from a front edge of the sole toward a heel portion of the sole.

9. The sole of claim 8, wherein the slit is positioned between a portion of the sole configured to support a big toe of a wearer and a portion of the sole configured to support a second toe of a wearer.

10. The sole of claim 8, wherein a plurality of the fins positioned rearwardly of the slit comprise a first segment and a second segment spaced apart from one another by a gap.

11. The sole of claim 10, wherein the gap is aligned with the slit.

12. The sole of claim 1, further comprising a plurality of grooves formed in a lower surface of the peripheral lip.

13. The sole of claim 1, further comprising a plurality of indentations formed in an outer edge peripheral lip.

14. The sole of claim 1, further comprising a pair of lateral indentations formed in a lateral edge of the forward portion of the sole;

a pair of medial indentations formed in a medial edge of the forward portion of the sole; and a pair of transverse gaps separating, each transverse gap extending between a lateral indentation and an opposed medial indentation and spacing apart the fins positioned forwardly of the corresponding lateral and medial indentations.

15. The sole of claim 1, wherein at least one of the fins extends substantially parallel to a longitudinal axis of the sole.

16. The sole of claim 1, wherein the sole is formed of a first portion and a second portion, the fins being part of the first portion and the peripheral lip being part of the second portion.

17. The sole of claim 16, wherein the first portion has a different color than the second portion.

18. The sole of claim 16, wherein the first portion is formed of a first material and the second portion is formed of a second material different than the first material.

19. An article of footwear for granular surfaces comprising, in combination:

an upper;

a sole secured to the upper having a lower surface, a peripheral lip projecting downwardly and outwardly from the lower surface and extending about the entire periphery of the sole, and a plurality of downwardly projecting fins, at least some of the fins angled rearwardly from the sole, and at least some of the fins extending transversely across substantially an entire width of the lower surface; and an inner lip projecting downwardly and outwardly from the lower surface of the sole and spaced inwardly of the peripheral lip such that a recess is formed between the peripheral lip and the inner lip, the inner lip extending around a heel portion of the sole.

20. The article of footwear of claim 19, wherein all of the fins are angled rearwardly from the sole.

21. The article of footwear of claim 19, wherein some of the fins are angled forwardly from the sole.

22. The article of footwear of claim 19, wherein a portion of the recess is filled.

23. The article of footwear of claim 19, wherein the sole is formed of a compressible material.

24. The article of footwear of claim 23, wherein the compressible material is ethyl vinyl acetate.

25. The article of footwear of claim 19, wherein outer edges of the fins are angled inwardly from the sole.

26. The article of footwear of claim 19, further comprising a slit formed in a toe portion of the sole, the slit extending from a front edge of the sole toward a heel portion of the sole.

27. The article of footwear of claim 26, wherein the slit is positioned between a portion of the sole configured to support a big toe of a wearer and a portion of the sole configured to support a second toe of a wearer.

28. The article of footwear of claim 26, wherein a plurality of the fins positioned rearwardly of the slit comprise a first segment and a second segment spaced apart from one another by a gap.

29. The article of footwear of claim 28, wherein the gap is aligned with the slit.

30. The article of footwear of claim 19, further comprising a plurality of grooves formed in a lower surface of the peripheral lip.

31. The article of footwear of claim 19, further comprising a plurality of indentations formed in an outer edge peripheral lip.

32. The article of footwear of claim 19, further comprising a pair of lateral indentations formed in a lateral edge of the forward portion of the sole;

a pair of medial indentations formed in a medial edge of the forward portion of the sole; and a pair of transverse gaps separating, each transverse gap extending between a lateral indentation and an opposed medial indentation and spacing apart the fins positioned forwardly of the corresponding lateral and medial indentations.

33. The article of footwear of claim 19, wherein at least one of the fins extends substantially parallel to a longitudinal axis of the sole.

34. The article of footwear of claim 19, wherein the sole is formed of a first portion and a second portion, the fins being part of the first portion and the peripheral lip being part of the second portion.

35. The sole of claim 34, wherein the first portion has a different color than the second portion.

36. The sole of claim 34, wherein the first portion is formed of a first material and the second portion is formed of a second material different than the first material.

37. A sole for an article of footwear to be used on a granular surface comprising, in combination:

a sole of compressible material having an upper surface and a lower surface;

a peripheral lip projecting downwardly and outwardly from the lower surface;

a plurality of grooves formed in a lower surface of the peripheral lip in a forward portion of the sole;

an inner lip projecting downwardly and outwardly from the lower surface around a heel portion of the sole, and spaced inwardly of the peripheral lip such that a recess is formed between the peripheral lip and the inner lip, a portion of the recess being filled with the compressible material;

a slit formed in a toe portion of the sole, the peripheral lip forming opposed walls of the slit, the slit being positioned between a portion of the sole configured to support a big toe of a wearer and a portion of the sole configured to support a second toe of a wearer;

a plurality of transversely extending fins projecting downwardly and rearwardly from the lower surface of the sole, the slit dividing some of the fins into first and second segments spaced apart from one another by a longitudinal gap, the longitudinal gap being aligned with the slit;

a pair of lateral indentations formed in a lateral edge of the forward portion of the sole;

a pair of medial indentations formed in a medial edge of the forward portion of the sole; and a pair of transverse gaps separating, each transverse gap extending between a lateral indentation and an opposed medial indentation and spacing apart the fins positioned forwardly of the corresponding lateral and medial indentations.

* * * * *

UNITED STATES PATENT AND TRADEMARK OFFICE

CERTIFICATE OF CORRECTION

PATENT NO. : 7,204,044 B2
APPLICATION NO. : 10/820439
DATED : April 17, 2007
INVENTOR(S) : Kevin Hoffer et al.

It is certified that error appears in the above-identified patent and that said Letters Patent is hereby corrected as shown below:

Column 7, line 63 should read as follows:

a pair of transverse gaps ~~separating~~

Column 8, line 66 should read as follows:

a pair of transverse gaps ~~separating~~

Column 10, line 20 should read as follows:

a pair of transverse gaps ~~separating~~

Signed and Sealed this

Twenty-ninth Day of May, 2007

JON W. DUDAS
*Director of the United States Patent and Trademark Office*